US006708586B1

(12) United States Patent
Chen

(10) Patent No.: US 6,708,586 B1
(45) Date of Patent: Mar. 23, 2004

(54) RATCHET WRENCH HAVING A DIRECTION CONTROLLER THAT IS ASSEMBLED EASILY

(76) Inventor: Yu Tang Chen, No. 36, 37 Alley, 76 Lane, Sec. 1, Hsing-Lung Rd., Taiping City, Taichung (TW)

( * ) Notice: Subject to any disclaimer, the term of this patent is extended or adjusted under 35 U.S.C. 154(b) by 0 days.

(21) Appl. No.: 10/270,362

(22) Filed: Oct. 15, 2002

(51) Int. Cl.[7] ..... B25B 13/46
(52) U.S. Cl. ..... 81/63.2; 81/63
(58) Field of Search ..... 81/60–63.2

(56) References Cited

U.S. PATENT DOCUMENTS 6,457,389 B1 * 10/2002 Hu ..... 81/63.2
6,543,316 B2 * 4/2003 Daigle et al. ..... 81/63
6,609,444 B1 * 8/2003 Hsien ..... 81/63.2
2003/0150299 A1 * 8/2003 Chen ..... 81/63.2

* cited by examiner

*Primary Examiner*—D. S. Meislin
(74) *Attorney, Agent, or Firm*—Rosenberg, Klein & Lee

(57) ABSTRACT

A ratchet wrench includes a drive head, a ratchet wheel, a direction controller, and a pawl member. The direction controller is formed with a slit facing the expansion slot of the drive head. An insertion plate is mounted in the expansion slot of the drive head, and has a first side provided with a flat cut edge that may be inserted into the slit of the direction controller, and a second side provided with an arcuate edge that is rested on an outer edge of the shaft of the ratchet wheel. Thus, the direction controller may be directly mounted on the drive head, so that the ratchet wrench has a simplified construction and may be assembled and disassembled easily and conveniently.

8 Claims, 2 Drawing Sheets

RATCHET WRENCH HAVING A DIRECTION CONTROLLER THAT IS ASSEMBLED EASILY

BACKGROUND OF THE INVENTION

1. Field of the Invention

The present invention relates to a ratchet wrench having a direction controller that is assembled easily, and more particularly to a ratchet wrench having a direction controller that may be directly mounted on the drive head, so that the ratchet wrench has a simplified construction and may be assembled and disassembled easily and conveniently.

2. Description of the Related Art conventional ratchet wrench in accordance with the prior art comprises a wrench body having a drive head, a ratchet wheel rotatably mounted on the drive head, a direction controller pivotally mounted on the drive head, and a pawl member mounted between the direction controller and the ratchet wheel. Thus, the direction controller may drive the pawl member to control the rotational direction of the ratchet wheel. However, the direction controller is mounted on the drive head by a complicated mounting structure, so that the ratchet wrench has a complicated construction and cannot be assembled and disassembled easily and conveniently, thereby increasing the cost of fabrication.

SUMMARY OF THE INVENTION

The present invention has arisen to mitigate and/or obviate the disadvantage of the conventional ratchet wrench.

The primary objective of the present invention is to provide a ratchet wrench having a direction controller that is assembled easily.

Another objective of the present invention is to provide a ratchet wrench having a direction controller that is assembled easily, wherein the direction controller may be directly mounted on the drive head, so that the ratchet wrench has a simplified construction and may be assembled and disassembled easily and conveniently.

In accordance with the present invention, there is provided a ratchet wrench having a direction controller that is assembled easily, comprising a drive head, a ratchet wheel rotatably mounted on a bottom face of the drive head, a direction controller pivotally mounted on a top face of the drive head, and a pawl member mounted between the direction controller and the ratchet wheel;

the drive head has a bottom face formed with a receiving chamber for receiving the ratchet wheel and the pawl member, the receiving chamber has a wall having a closed upper portion formed with a shaft recess, the drive head has a top face formed with a pivot hole communicating with the receiving chamber, the ratchet wheel has a top portion provided with a shaft rotatably mounted in the shaft recess of the drive head; wherein: the wall of the receiving chamber is formed with an expansion slot communicating with the shaft recess and the pivot hole, the direction controller has a periphery formed with a slit facing the expansion slot of the drive head, and the ratchet wrench further comprises an insertion plate mounted in the expansion slot of the drive head, the insertion plate has a first side provided with a flat cut edge that may be inserted into the slit of the direction controller, and a second side provided with an arcuate edge that is rested on an outer edge of the shaft of the ratchet wheel.

Further benefits and advantages of the present invention will become apparent after a careful reading of the detailed description with appropriate reference to the accompanying drawings.

DETAILED DESCRIPTION OF THE INVENTION

Figure 1:
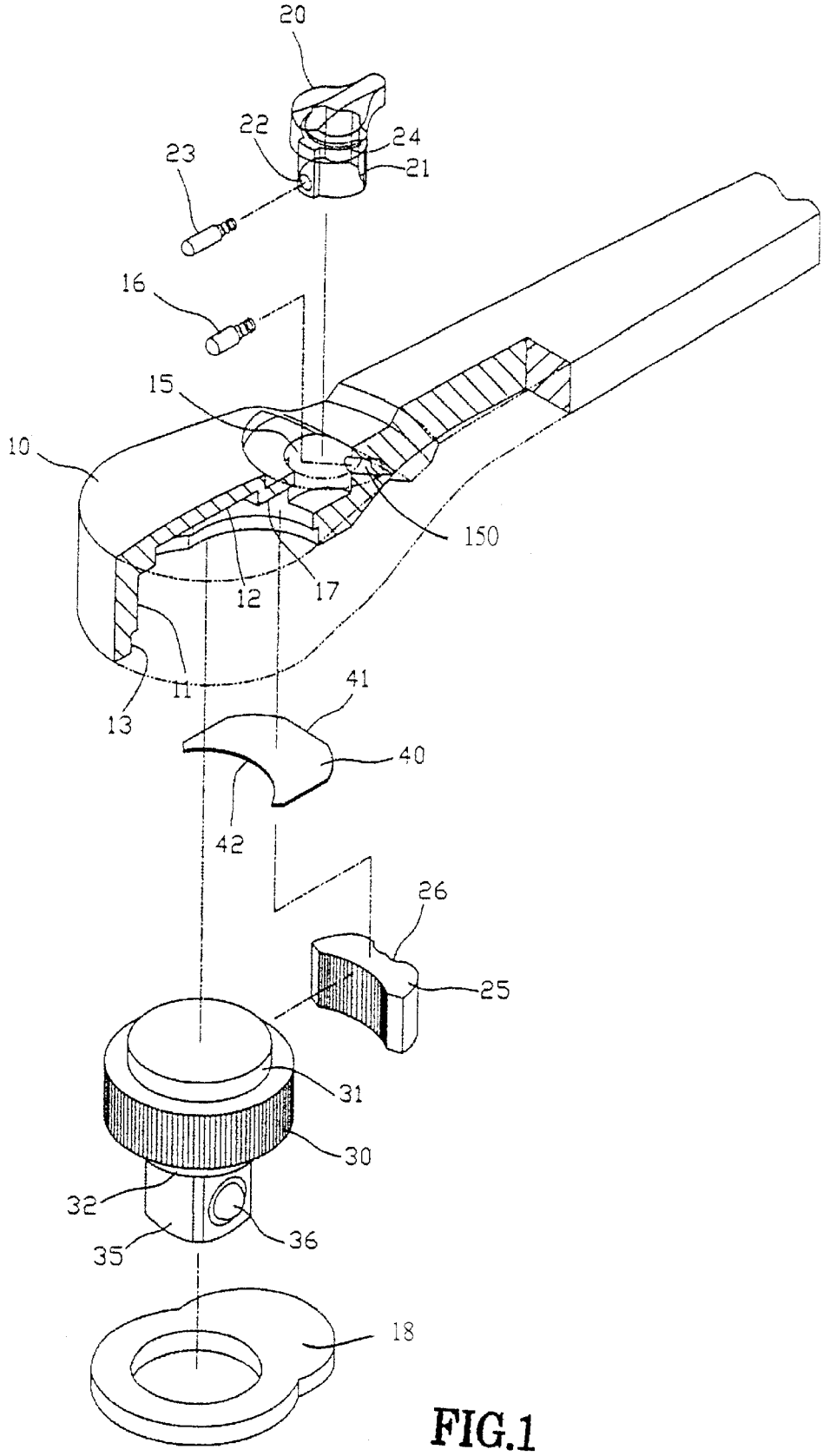
FIG. 1 is an exploded perspective view of a ratchet wrench having a direction controller that is assembled easily in accordance with a preferred embodiment of the present invention.

Referring to the drawings and initially to FIG. 1, a ratchet wrench having a direction controller that is assembled easily in accordance with a preferred embodiment of the present invention comprises a wrench body having a drive head 10, a ratchet wheel 30 rotatably mounted on a bottom face of the drive head 10, a direction controller 20 pivotally mounted on a top face of the drive head 10, and a pawl member 25 mounted between the direction controller 20 and the ratchet wheel 30. Thus, the direction controller 20 may drive the pawl member 25 to control the rotational direction of the ratchet wheel 30.

Figure 2:
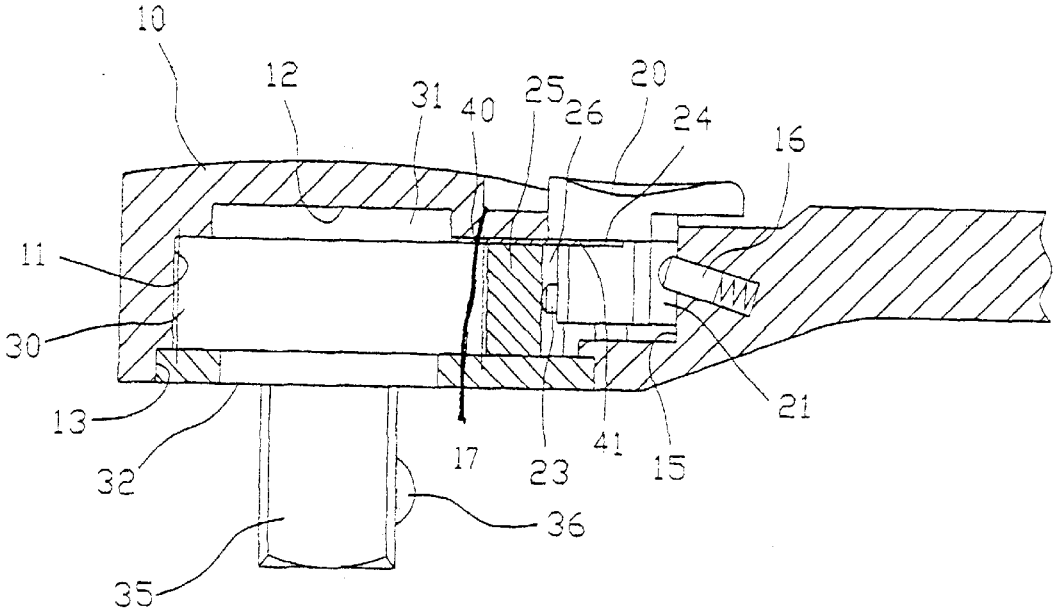
FIG. 2 is a side plan cross-sectional assembly view of the ratchet wrench having a direction controller that is assembled easily as shown in FIG. 1.
Figure 3:
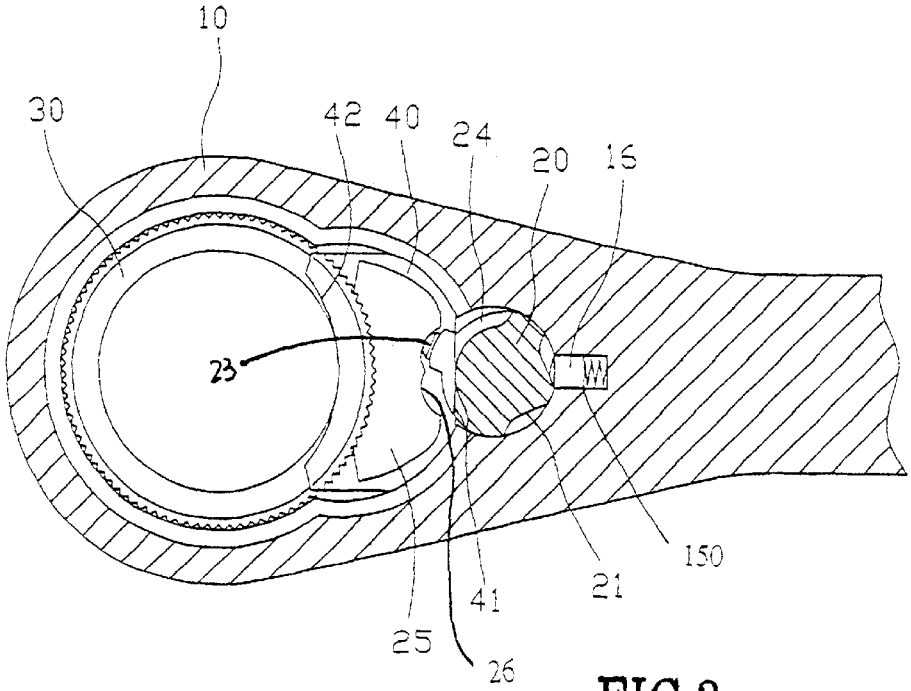
FIG. 3 is a top plan cross-sectional assembly view of the ratchet wrench having a direction controller that is assembled easily as shown in FIG. 1.

Referring to FIGS. 1–3, the drive head 10 has a bottom face formed with a receiving chamber 11 for receiving the ratchet wheel 30 and the pawl member 25. The receiving chamber 11 has a wall having a closed upper portion formed with a shaft recess 12 for receiving a top portion of the ratchet wheel 30, and an opened lower portion provided with a stepped edge 13 for limiting the ratchet wheel 30. The drive head 10 has a top face formed with a pivot hole 15 communicating with the receiving chamber 11 for receiving the direction controller 20. The pivot hole 15 has a wall formed with a receiving space 150 for receiving an elastic positioning stub 16 which is urged on a periphery of the direction controller 20 for positioning the direction controller 20. The wall of the receiving chamber 11 is formed with an expansion slot 17 communicating with the shaft recess 12 and the pivot hole 15.

The direction controller 20 pivotally mounted in the pivot hole, 15 of the drive head 10 has a first side formed with a concave positioning edge 21 rested on the elastic positioning stub 16, and a second side formed with an insertion hole 22 for insertion of an elastic member 23 which is urged on a periphery of the pawl member 25. The direction controller 20 has a periphery formed with a slit 24 facing the expansion slot 17 of the drive head 10. Preferably, the slit 24 is integrally formed in the direction controller 20. The pawl member 25 has a first side formed with a limit recess 26 for retaining the elastic member 23 of the direction controller 20, and a second side engaged with a periphery of the ratchet wheel 30.

The ratchet wheel 30 has a top portion provided with a shaft 31 rotatably mounted in the shaft recess 12 of the drive head 10, and a bottom portion provided with a stepped edge 32 for limiting movement of the ratchet wheel 30. The stepped edge 32 of the ratchet wheel 30 has a bottom provided with a downward protruding socket stud 35 which is provided with a retaining ball 36.

The ratchet wrench in accordance with the present invention further comprises a sheet-shaped insertion plate 40 mounted in the expansion slot 17 of the drive head 10. The insertion plate 40 has a first side provided with a flat cut edge 41 that may be inserted into the slit 24 of the direction controller 20 (see FIG. 3), and a second side provided with an arcuate edge 42 that is rested on an outer edge of the shaft 31 of the ratchet wheel 30. The pawl member 25 is urged on a bottom of the insertion plate 40, so that the direction controller 20 may be retained on the drive head 10.

In assembly, the direction controller 20 is pivotally mounted in the pivot hole 15 of the drive head 10, with the slit 24 of the direction controller 20 aligning with the expansion slot 17 of the drive head 10. Then, the insertion plate 40 is mounted in the expansion slot 17 of the drive head 10, and the flat cut edge 41 of the insertion plate 40 is inserted into the slit 24 of the direction controller 20 for locking the direction controller 20. Then, the ratchet wheel 30 is rotatably mounted in the receiving chamber 11 of the drive head 10, with the arcuate edge 42 of the insertion plate 40 being rested on the outer edge of the shaft 31 of the ratchet wheel 30. Then, the pawl member 25 is pivotally mounted in the receiving chamber 11 of the drive head 10, and is urged on the bottom of the insertion plate 40, so that the direction controller 20 may be retained on the drive head 10. Finally, a bottom cap 18 is mounted in the receiving chamber 11 of the drive head 10, and is rested on the stepped edge 13 of the drive head 10 and the stepped edge 32 of the ratchet wheel 30, thereby assembling the ratchet wrench in accordance with the present invention.

In such a manner, the insertion plate 40 may be used to retain the direction controller 20 on the drive head 10.

Accordingly, the ratchet wrench in accordance with the present invention has a simplified construction, and may be assembled and disassembled easily and conveniently, thereby decreasing the cost of fabrication.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench having a direction controller that is assembled easily, comprising a drive head, a ratchet wheel rotatably mounted on a bottom face of the drive head, a direction controller pivotally mounted on a top face of the drive head, and a pawl member mounted between the direction controller and the ratchet wheel;

the drive head has a bottom face formed with a receiving chamber for receiving the ratchet wheel and the pawl member, the receiving chamber has a wall having a closed upper portion formed with a shaft recess, the drive head has a top face formed with a pivot hole communicating with the receiving chamber, the ratchet wheel has a top portion provided with a shaft rotatably mounted in the shaft recess of the drive head; wherein:

the wall of the receiving chamber is formed with an expansion slot communicating with the shaft recess and the pivot hole, the direction controller has a periphery formed with a slit facing the expansion slot of the drive head, and the ratchet wrench further comprises an insertion plate mounted in the expansion slot of the drive head, the insertion plate has a first side provided with a flat cut edge that may be inserted into the slit of the direction controller, and a second side provided with an arcuate edge that is rested on an outer edge of the shaft of the ratchet wheel.

2. The ratchet wrench having a direction controller that is assembled easily in accordance with claim 1, wherein the slit is integrally formed in the direction controller.

3. The ratchet wrench having a direction controller that is assembled easily in accordance with claim 1, wherein the wall of the receiving chamber has an opened lower portion provided with a stepped edge for limiting the ratchet wheel.

4. The ratchet wrench having a direction controller that is assembled easily in accordance with claim 1, wherein the pivot hole has a wall formed with a receiving space for receiving an elastic positioning stub which is urged on a periphery of the direction controller for positioning the direction controller.

5. The ratchet wrench having a direction controller that is assembled easily in accordance with claim 4, wherein the direction controller is pivotally mounted in the pivot hole of the drive head and has a first side formed with a concave positioning edge rested on the elastic positioning stub, and a second side formed with an insertion hole for insertion of an elastic member which is urged on a periphery of the pawl member.

6. The ratchet wrench having a direction controller that is assembled easily in accordance with claim 5, wherein the pawl member has a first side formed with a limit recess for retaining the elastic member of the direction controller, and a second side engaged with a periphery of the ratchet wheel.

7. The ratchet wrench having a direction controller that is assembled easily in accordance with claim 1, wherein the ratchet wheel has a bottom portion provided with a stepped edge for limiting movement of the ratchet wheel.

8. The ratchet wrench having a direction controller that is assembled easily in accordance with claim 1, wherein the pawl member is urged on a bottom of the insertion plate.

* * * * *